US007501089B2

(12) United States Patent
Armstrong et al.

(10) Patent No.: US 7,501,089 B2
(45) Date of Patent: Mar. 10, 2009

(54) METHOD AND APPARATUS FOR CONTROLLING THE SIZE OF POWDER PRODUCED BY THE ARMSTRONG PROCESS

(75) Inventors: Donn Reynolds Armstrong, Lisle, IL (US); Richard Paul Anderson, Clarendon Hills, IL (US); Lance E. Jacobsen, Minooka, IL (US)

(73) Assignee: Cristal US, Inc., Hunt Valley, MD (US)

( * ) Notice: Subject to any disclaimer, the term of this patent is extended or adjusted under 35 U.S.C. 154(b) by 252 days.

(21) Appl. No.: 10/654,142

(22) Filed: Sep. 3, 2003

(65) Prior Publication Data

US 2005/0081682 A1 Apr. 21, 2005

Related U.S. Application Data

(60) Provisional application No. 60/408,924, filed on Sep. 7, 2002, provisional application No. 60/408,825, filed on Sep. 7, 2002.

(51) Int. Cl.
*C22B 34/12* (2006.01)
*C22B 3/02* (2006.01)

(52) U.S. Cl. ..... 266/168; 266/171

(58) Field of Classification Search ..... 266/168, 266/171

See application file for complete search history.

(56) References Cited

U.S. PATENT DOCUMENTS

| | | | | | |
|---|---|---|---|---|---|
| 4,402,741 | A | * | 9/1983 | Pollet et al. | 75/681 |
| 4,915,729 | A | * | 4/1990 | Boswell et al. | 75/331 |
| 4,941,646 | A | * | 7/1990 | Stelts et al. | 266/270 |
| 5,176,741 | A | * | 1/1993 | Bartlett et al. | 75/360 |
| H1624 | H | * | 1/1997 | Ogden et al. | 261/123 |
| 5,779,761 | A | * | 7/1998 | Armstrong et al. | 75/370 |
| 5,958,106 | A | * | 9/1999 | Armstrong et al. | 75/370 |
| 6,824,585 | B2 | * | 11/2004 | Joseph et al. | 75/10.19 |

* cited by examiner

*Primary Examiner*—George Wyszomierski
(74) *Attorney, Agent, or Firm*—Dunlap Codding, P.C.

(57) ABSTRACT

A needle valve is disclosed for controlling the quantity of a halide vapor to be injected into a liquid metal. The needle valve may seat in a supersonic nozzle from which the halide vapor exits. Various products made with the apparatus of the invention are disclosed.

14 Claims, 3 Drawing Sheets

METHOD AND APPARATUS FOR CONTROLLING THE SIZE OF POWDER PRODUCED BY THE ARMSTRONG PROCESS

RELATED APPLICATIONS

This application, pursuant to 37 C.F.R. 1.78(c), claims priority based on provisional application U.S. Provisional Application Ser. No. 60/408,924 filed Sep. 7, 2002 and U.S. Provisional Application Ser. No. 60/408,825 filed Sep. 7, 2002

BACKGROUND OF THE INVENTION

This invention relates to the Armstrong process as described in U.S. Pat. Nos. 5,779,761, 5,958,106 and 6,409,797, the disclosures of each of which is incorporated herein by reference. As illustrated in the above-referenced patents, a reductant metal and a halide of the metal to be produced are introduced into a reactor chamber. For instance, in the '106 patent, a sodium stream from a source of sodium is pumped by a pump 11 into a reaction chamber 14. Titanium tetrachloride from a source thereof is fed by a pump 21 to a boiler 22. From the boiler 22, titanium tetrachloride vapor is also pumped to the reaction chamber 14.

The present invention relates in general to the Armstrong Process as described above but also more specifically to the reactor used in converting a halide vapor into a powder, either of ceramic or metal or alloy. More particularly, the invention relates in part to a needle valve used to introduce halide vapor into the liquid metal, such as sodium, providing significant advantages to the Armstrong Process. In another aspect of the invention, a supersonic nozzle is used for the introduction of the halide vapor to improve the mixing of the vapor with the liquid, reducing the expansion of the gas into the liquid which occurs with a sonic nozzle, thereby modifying the reactions advantageously.

SUMMARY OF THE INVENTION

Accordingly, an object of the present invention is to provide an apparatus for injecting halide vapor into a liquid metal in which a needle valve is used to carefully meter the amount of vapor introduced into the liquid metal.

Still another object of the invention is to provide an apparatus for introducing a halide vapor into a liquid metal environment in which a supersonic nozzle is employed.

Another object of the invention is to provide an apparatus and system for injecting a halide vapor subsurface of a liquid metal, comprising inner and outer conduits forming an annulus there between, a needle valve interior of the inner conduit movable axially thereof between an open position in which the inner conduit is in fluid communication with the outer conduit and a closed position in which the inner conduit is sealed from the outer conduit, a supply of halide vapor in fluid communication with the inner conduit, a supply of liquid metal in fluid communication with the outer conduit, and an actuator assembly connected to the needle valve for moving the needle valve axially of the inner conduit between the open and sealed positions thereof, whereby introduction of halide vapor into liquid alkali or alkaline earth metal or mixtures thereof present in the annulus results in an exothermic reaction controlled at least in part by the axial position of the needle valve.

A still further object of the present invention is to provide an apparatus and system of the type set forth incorporating a supersonic nozzle.

Another object of the present invention is to provide a system for making a powder by the exothermic reduction of a halide vapor with an alkali metal or an alkaline earth metal or mixtures thereof, comprising a supply of liquid alkali or alkaline earth metal or mixtures thereof, a supply of a halide vapor, an apparatus for injecting the halide vapor subsurface of the liquid metal having inner and outer conduits forming an annulus there between, a needle valve interior of the inner conduit movable axially thereof between an open position in which the inner conduit is in fluid communication with the outer conduit and a closed position in which the inner conduit is sealed from the outer conduit, the supply of halide vapor being in fluid communication with the inner conduit, the supply of liquid metal in being fluid communication with the outer conduit, and an actuator assembly connected to the needle valve for moving the needle valve axially of the inner conduit between the open and sealed positions thereof, whereby introduction of halide vapor into liquid alkali or alkaline earth metal or mixtures thereof present in the annulus results in an exothermic reaction controlled at least in part by the axial position of the needle valve producing the powder and the halide salt of the liquid metal.

Still another object of the present invention is to provide a system of the type previously set forth using a supersonic nozzle without a needle valve to introduce the halide vapor into the liquid metal.

A final object of the present invention is to provide powder made by the operation of the apparatus and systems disclosed, the powder being a ceramic, a metal or an alloy with or without conversion to a solid product from the powder.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
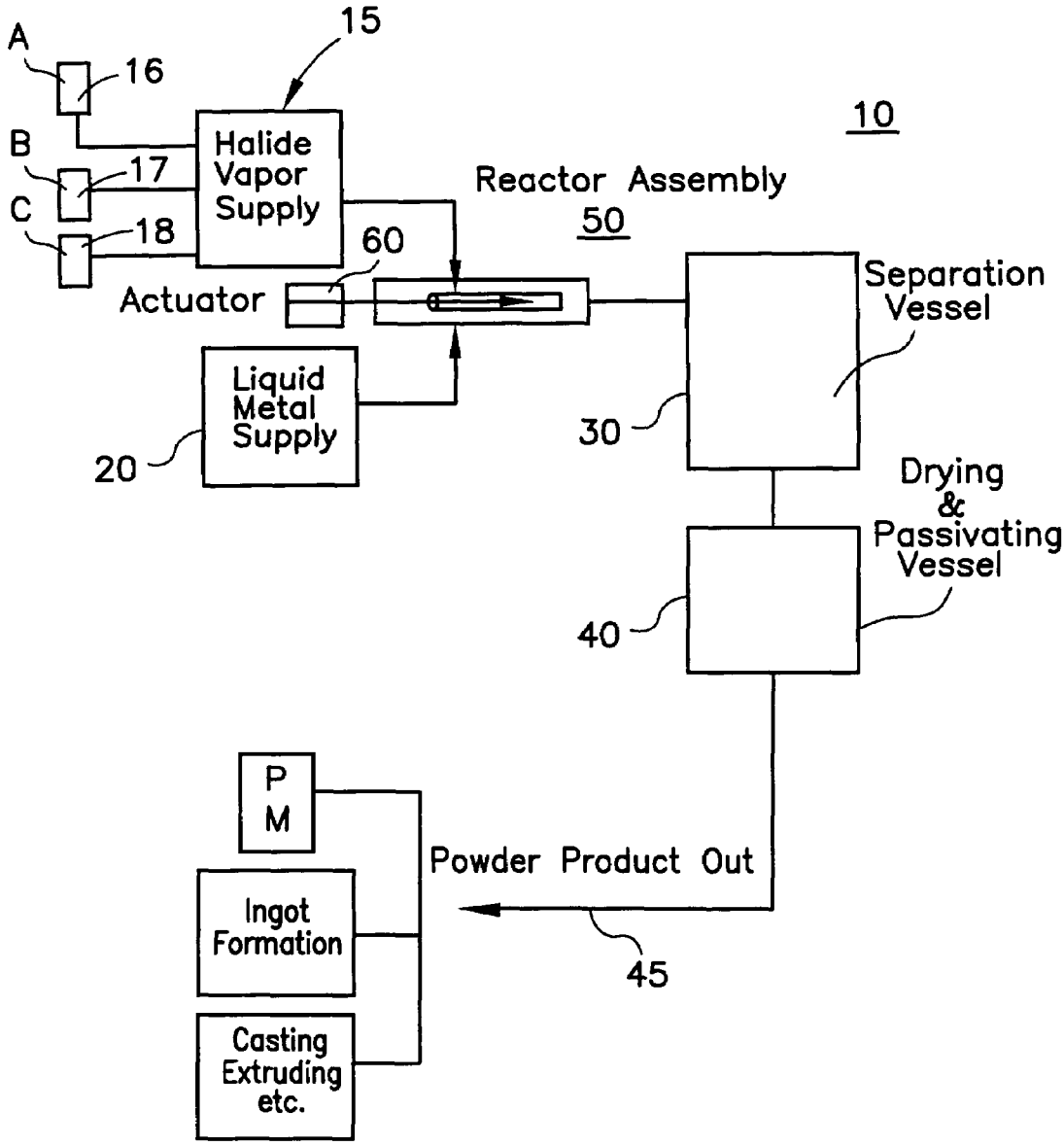
FIG. 1 is a schematic representation of a system for practicing the present invention.

Referring to FIG. 1 of the drawings, there is disclosed a system 10 for the practice of the present invention including a supply of halide vapor 15 which in turn is in fluid communication with a plurality of liquid halide or solid halide materials, shown for purposes of illustration only as supplies 16, 17 and 18 for halide liquids or solids A, B and C respectively. The system 10 further includes a supply of liquid metal 20 which may be any alkali or alkaline earth metal or various mixtures thereof, sodium and magnesium being preferred with sodium being mostly preferred.

Similarly, with respect to the halide vapor supply 15, chlorides are preferred.

There is further provided a separation vessel 30 in fluid communication with a reactor assembly 50, as will be described and the separation vessel 30 is also in fluid communication with a drying and passivating vessel 40. A powder product outlet 45 is in fluid communication with the drying and passivating vessel 40, as will be described, is either the final product or the intermediate product of the system and process of the invention.

Figure 2:
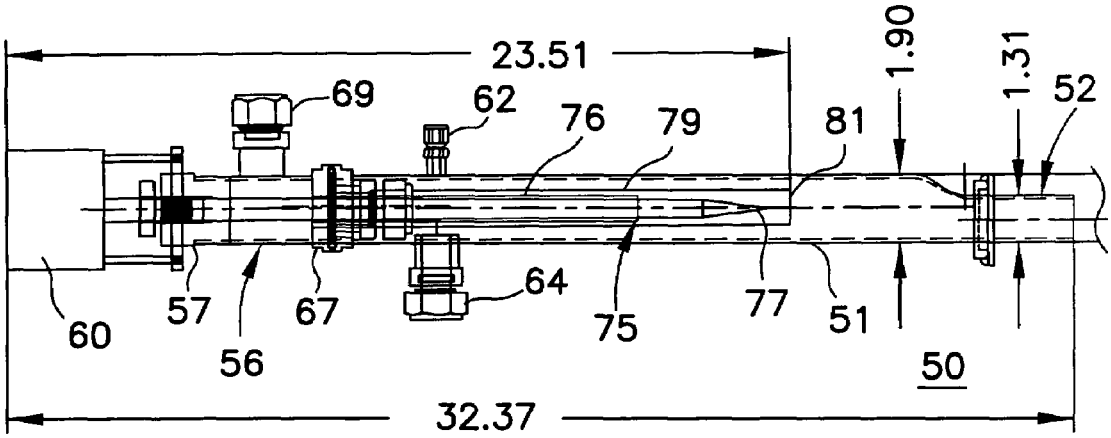
FIG. 2 is a schematic representation of a needle valve assembly useful in the present invention.

The present invention and system 10 includes the reactor assembly 50, as seen in FIG. 2, which has an outer cylinder 51 having an exit portion 52 which may be of reduced diameter or of the same diameter as the remainder of the outer cylinder or conduit 51, as preferred.

The reactor assembly 50 serves to receive the halide of the metal or ceramic to be produced and the liquid reducing metal and to introduce the halide in a controlled fashion subsurface of the reducing metal or into a stream of the reducing metal so that the temperature of the reaction is controlled, in part, by the excess of the reducing metal, all is taught in the above-referenced patents.

The reactor assembly 50 has one-half of a sealing ring 54 on the exit nozzle portion 52 to sealing engage another sealing ring (not shown) located in the vessel into which the exit portion 52 is positioned. The outer cylinder 51 also has a inlet nozzle portion 56 which terminates in an end 57. An actuator 60, either pneumatic or otherwise, as is known in the art, is in communication with the reactor assembly 50 and particularly the outer cylinder 51 as will be explained. The outer cylinder 51 also has a pressure tap 62 which may be for the introduction of an inert gas such as argon or to vent the assembly 50, if required, or to monitor the pressure within the outer cylinder 51. Also provided is a reducing metal inlet 64, in the illustration a sodium inlet. Both the pressure tap 62 and the reducing metal inlet 64 extend through the outer cylinder 51 and are sealed thereto.

A sealing ring is made up of mating halves 66 and 67 intermediate the actuator 60 and the exit nozzle portion 52 of the reactor assembly 50. A halide inlet tap 69 extends into the inlet nozzle portion 56 of the outer cylinder 51 and is sealed downstream of the inlet 69 by means of the sealing rings 66, 67 and is in fluid communication with a housing 79 which may be generally cylindrical in shape and extends from the sealing half ring 66 through the outer cylinder 51 and terminates at an end 81 having a valve seat therein.

A needle valve 75 includes an elongated cylindrical shaft portion 76 having a conical shape valve portion 77 and another end 78 in communication with the actuator 60. The halide inlet 69 introduces halide vapor into the chamber formed by the inlet nozzle portion 56 of the outer cylinder 51 and enters the housing 79 by virtue of the communication between the end of the housing 79 and the sealing rings 66, 67. The sodium entering through sodium inlet 64 is on the outside of the housing 79 and completely fills the outer cylinder 51 and flows axially of the outer cylinder. The longitudinal axial movement of the needle valve 75 by means of the actuator 60 causes the conical end portion 77 to seat within a valve seat in the end 81 of the housing 79, it being apparent to those of ordinary skill in the art that the diameter of the valve seat in the end 81 must be smaller than the diameter of the shaft portion 76 of the needle valve 75. Valve seats 81 between ⅛ and ⅜ inch have been used with the appropriate change in shaft portion 76.

As stated in the above referenced patents, it is important that no sodium be able to back up through the valve seat in the end 81 into the halide vapor supply. That necessity is accomplished by using at least sonic flow of the halide through reactor assembly 50 as taught in the referenced patent. As the actuator 60 is operated to move the shaft portion 76 axially of outer cylinder 51 to the right in FIG. 1 so that the conical portion 77 of the needle valve 75 begins to seat within the valve seat in the end 81, the amount or volume of halide vapor, such as titanium tetrachloride, introduced into the sodium or reducing metal inside the outer cylinder 51 is reduced or controlled permitting the operators of the system to vary the time and rate of delivery of the halide vapor. Another advantage of the needle valve 75 is that when the needle valve 75 is fully seated within the valve seat in the end 81, a vacuum may be drawn upstream of the nozzle or reactor assembly 50 before startup of the production of the metal by the exothermic reaction of the halide with the reducing metal.

Figure 3:
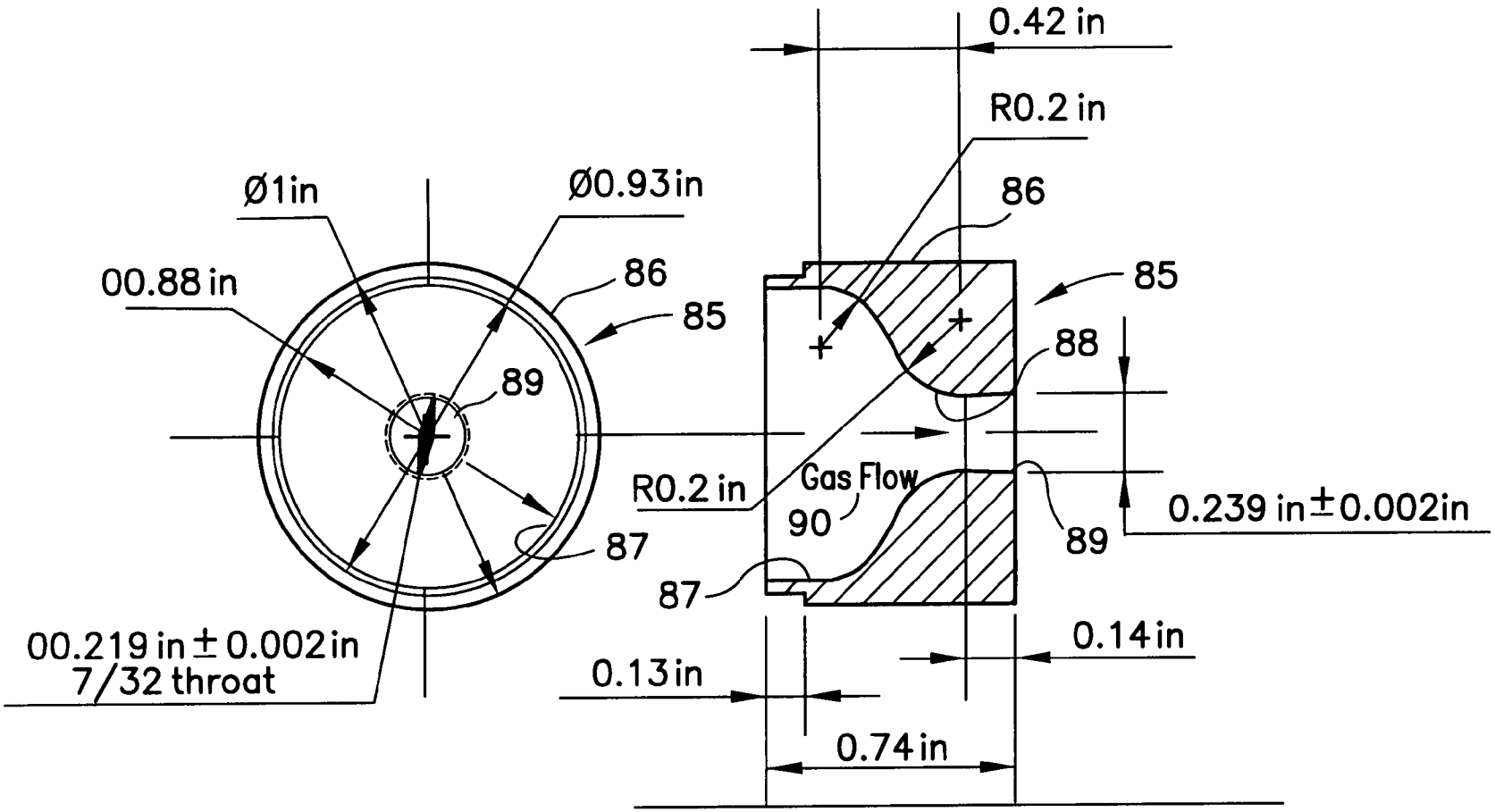
FIG. 3 is a schematic representation of a supersonic nozzle useful in the practice of the present invention.

Referring now to FIG. 3, there is disclosed a supersonic nozzle 5 including an elongated housing 86 having a first larger diameter 87 and a throat 88. The terminal or distal diameter 89 is larger than the throat 88 and smaller than the internal diameter 87, all as well known in the art. Representative but not limiting dimensions are on FIG. 3, the arrow 90 being indicative of the gas flow through the nozzle 85.

The use of a supersonic nozzle 85 distinguished to a sonic nozzle is an improvement to the process disclosed in the above captioned patents. The supersonic nozzle 85 alters the flow pattern of the halide gas flow 90 and permits the halide gas to flow at a higher velocity at the entry point to the reductant metal. Also, the use of a supersonic nozzle 85 reduces the expansion of the halide gas as it enters the reductant metal thereby altering the size and shape of the reaction zone.

More specifically, when using a sonic nozzle, the vapor exiting the nozzle is at an over pressure condition which causes it instantly to expand at the end of the nozzle as the gas enters the liquid reductant. The use of a supersonic nozzle 85 (FIG. 3), permits the gas to exit the nozzle without being in an over pressurized condition and without the subsequent expansion associated with a sonic nozzle. By virtue of the use of the supersonic nozzle 85, a modified reaction zone is obtained in which various size and morphology characteristics of the product powder are altered and may also reduce the oxygen content of the powder produced. Designs of supersonic nozzles 85 are well known, the FIG. 3 shows a nozzle 85 having slightly larger diameter exit point 89 than the smallest diameter of the nozzle throat 88. Specifically, the exit diameter 89 of the nozzle 85 is 0.239 inches plus or minus 0.002 inches, and the narrowest part of the throat 88 is 0.219 inches plus or minus 0.002 inches. The invention is applicable to reductions of various halides with a wide variety of reductant metals, all as set forth in the above three referenced patents.

Referring again to FIG. 1, it is seen that the powder product 45 discharged from the drying and passivating vessel 40 may be used as a product in and of itself or may be used in powder metallurgy to produce product or ingot or other means by which solid product is formed which also includes casting, extruding or other methods. Any solid product or object made from the powder 45 produced by the inventive system 10 is within the purview of the present invention.

While there has been disclosed what is considered to be the preferred embodiment of the present invention, it is understood that various changes in the details may be made without departing from the spirit, or sacrificing any of the advantages of the present invention.

What is claimed is:

1. An apparatus for injecting a halide vapor subsurface of a liquid metal, comprising inner and outer conduits forming an annulus there between, said inner conduit having an end forming a supersonic nozzle terminating within said outer conduit, a valve in communication with said inner conduit movable between an open position in which said inner conduit is in fluid communication with said outer conduit and a closed position in which said inner conduit is sealed from said outer conduit, a supply of halide vapor in fluid communication with said inner conduit, a supply of liquid metal in fluid communication with said outer conduit, and an actuator assembly connected to said valve for moving said valve between the open and sealed positions thereof, whereby introduction of halide vapor into liquid alkali or alkaline earth metal or mixtures thereof present in said annulus through said supersonic nozzle results in an exothermic reaction controlled at least in part by the position of said needle valve.

2. The apparatus of claim 1, wherein said supply of halide vapor includes one or more of the halides of Ti, Al, Sb, Be, B, Ta, Zr, V, Nb, Mo, Ga, U, Re, or Si.

3. The apparatus of claim 2, wherein said supply of liquid metal contains one or more of Na or Mg.

4. The apparatus of claim 3, wherein said supply of halide vapor includes TiCl4.

5. The apparatus of claim 4, wherein said supply of liquid metal is Na.

6. The apparatus of claim 5 wherein said supply of halide vapor also includes the chlorides of Al and V.

7. An apparatus for injecting a halide vapor subsurface of a liquid metal, comprising inner and outer conduits forming an annulus there between, said inner conduit having an end forming a supersonic nozzle terminating within said outer conduit, a needle valve in communication with said inner conduit movable axially thereof between an open position in which said inner conduit is in fluid communication with said outer conduit and a closed position in which said inner conduit is sealed from said outer conduit, a supply of halide vapor in fluid communication with said inner conduit, a supply of liquid metal in fluid communication with said outer conduit, and an actuator assembly connected to said needle valve for moving said needle valve axially between the open and sealed positions thereof, whereby introduction of halide vapor into liquid alkali or alkaline earth metal or mixtures thereof present in said annulus through said supersonic nozzle results in an exothermic reaction controlled at least in part by the axial position of said needle valve.

8. The apparatus of claim 7, wherein said supply of halide vapor includes one or more of the chloride of Ti, Al, Sb, Be, B, Ta, Zr, V, Nb, Mo, Ga, U, Re, or Si.

9. The apparatus of claim 8, wherein said supply of liquid metal contains one or more of Na or Mg.

10. The apparatus of claim 9, wherein said supply of halide vapor includes $TiCl_4$ and said liquid metal is Na.

11. The apparatus of claim 8, wherein said supply of halide vapor also includes the chlorides of Al and V.

12. A system for making a powder by the exothermic reduction of a halide vapor with an alkali metal or an alkaline earth metal or mixtures thereof, comprising a supply of liquid alkali or alkaline earth metal or mixtures thereof, a supply of a halide vapor, an apparatus for injecting the halide vapor subsurface of the liquid metal having inner and outer conduits forming an annulus there between, said inner conduit having an end forming a supersonic nozzle terminating within said outer conduit, a valve interior of said inner conduit movable between an open position in which said inner conduit is in fluid communication with said outer conduit and a closed position in which said inner conduit is sealed from said outer conduit, the supply of halide vapor being in fluid communication with said inner conduit, the supply of liquid metal in being fluid communication with said outer conduit, and an actuator assembly connected to said valve for moving said needle valve between the open and sealed positions thereof, whereby introduction of halide vapor into liquid alkali or alkaline earth metal or mixtures thereof present in said annulus results in an exothermic reaction controlled at least in part by said needle valve producing the powder and the halide salt of the liquid metal.

13. A system for making a powder by the exothermic reduction of a halide vapor with an alkali metal or an alkaline earth metal or mixtures thereof, comprising a supply of liquid alkali or alkaline earth metal or mixtures thereof, a supply of a halide vapor, n apparatus for injecting the halide vapor subsurface of the liquid metal having inner and outer conduits forming an annulus there between, said inner conduit having an end forming a supersonic nozzle terminating within said outer conduit, a needle valve interior of said inner conduit movable axially thereof between an open position in which said inner conduit is in fluid communication with said outer conduit and a closed position in which said inner conduit is sealed from said outer conduit, the supply of halide vapor being in fluid communication with said inner conduit, the supply of liquid metal in being fluid communication with said outer conduit, and an actuator assembly connected to said needle valve for moving said needle valve axially of said inner conduit between the open and sealed positions thereof, whereby introduction of halide vapor into liquid alkali or alkaline earth metal or mixtures thereof present in said annulus through said supersonic nozzle results in an exothermic reaction controlled at least in part by the axial position of said needle valve producing the powder and the halide salt of the liquid metal.

14. A system for making a powder by the exothermic reduction of a halide vapor with an alkali metal or an alkaline earth metal or mixtures thereof. comprising a supply of liquid alkali or alkaline earth metal or mixtures thereof, a supply of a halide vapor, an apparatus for iniecting the halide vapor subsurface of the liquid metal having inner and outer coaxial conduits forming an annulus there between, a needle valve interior of said inner conduit movable axially thereof between an open position in which said inner conduit is in fluid communication with said outer conduit and a closed position in which said inner conduit is sealed from said outer conduit, the supply of halide vapor being in fluid communication with said inner conduit, the supply of liquid metal in being fluid communication with said outer conduit. and an actuator assembly connected to said needle valve for moving said needle valve axially of said inner conduit between the open and sealed positions thereof, whereby introduction of halide vapor into liquid alkali or alkaline earth metal or mixtures thereof present in said annulus results in an exothermic reaction controlled at least in part by the axial position of said needle valve producing the powder and the halide salt of the liquid metal, wherein said inner conduit has a supersonic nozzle at the end thereof.

* * * * *

UNITED STATES PATENT AND TRADEMARK OFFICE

CERTIFICATE OF CORRECTION

PATENT NO. : 7,501,089 B2
APPLICATION NO. : 10/654142
DATED : March 10, 2009
INVENTOR(S) : Donn Reynolds Armstrong, Richard Paul Anderson and Lance E. Jacobsen It is certified that error appears in the above-identified patent and that said Letters Patent is hereby corrected as shown below:

Column 4, line 17: After “nozzle” delete “5” and replace with -- 85 --.

Signed and Sealed this

Fourteenth Day of July, 2009

JOHN DOLL
*Acting Director of the United States Patent and Trademark Office*